United States Patent [19]

Teets

[11] 4,429,527

[45] Feb. 7, 1984

[54] TURBINE ENGINE WITH COMBUSTOR PREMIX SYSTEM

[76] Inventor: J. Michael Teets, 12104 Gardenway G-7, Palm Beach Gardens, Fla. 33410

[21] Appl. No.: 275,157

[22] Filed: Jun. 19, 1981

[51] Int. Cl.[3] ..... F02C 7/224

[52] U.S. Cl. ..... 60/39.06; 60/39.23; 60/736; 60/737; 60/745

[58] Field of Search ..... 60/737, 745, 751, 736, 60/748, 39.29, 39.23, 39.826, 39.35, 39.83, 726, 60/738, 39.06; 415/177, 178

[56] References Cited

U.S. PATENT DOCUMENTS

| | | | |
|---|---|---|---|
| 2,471,892 | 5/1949 | Price | 60/35.6 |
| 2,568,921 | 9/1951 | Kroon | 60/745 |
| 2,946,185 | 7/1960 | Bayer | 239/433 |
| 3,055,179 | 9/1962 | Lefebvre et al. | 60/726 X |
| 3,407,596 | 10/1968 | Dasbach et al. | 60/737 |
| 3,563,031 | 2/1971 | Topouzian | 60/737 X |
| 3,570,242 | 3/1971 | Leonardi et al. | 60/737 |
| 3,603,082 | 9/1971 | Sneeden | 60/738 X |
| 3,932,988 | 1/1976 | Beaufrere | 60/737 |
| 3,938,324 | 2/1976 | Hammond, Jr. et al. | 60/737 |
| 4,005,572 | 2/1977 | Giffhorn | 60/39.28 R |
| 4,012,904 | 3/1977 | Nogle | 60/737 X |
| 4,100,733 | 7/1978 | Striebel et al. | 60/39.74 B |
| 4,195,476 | 4/1980 | Wood | 60/737 |

OTHER PUBLICATIONS

Szetela et al., "A Study of External Fuel Vaporization", *ASME,* 81-GT-158.

Nagey et al., "Low Emission Turbine Passenger Car?", *Mechanical Engineering,* Jan., 1974.

NASA Jet Propulsion Laboratory, "Two-Stage Combustor Reduces Pollutant Emissions", *NASA Tech Briefs,* Spring, 1981.

*Primary Examiner*—Carlton R. Croyle

*Assistant Examiner*—Donald E. Stout

*Attorney, Agent, or Firm*—Roylance, Abrams, Berdo & Goodman

[57] ABSTRACT

A turbine engine having a combustor premix system for mixing fuel and air to provide increased efficiency by reducing temperature peaks in the combustor. The system includes a primary mixing chamber for mixing compressed air and atomized fuel and a secondary mixing chamber located between the primary mixing chamber and the combustor for mixing additional compressed air to the fuel-air mixture. The secondary mixing chamber comprises a plurality of tubes with air metering ports in the walls thereof and a control assembly to vary the air flow to the ports for off design engine operating conditions, and optimizes fuel-air mixtures for the combustor at all engine operating speeds improving fuel economy and exhaust pollution control. The primary mixing chamber is located adjacent to and between the compressor for the air and the combustor so that the fuel-air mixture flowing therethrough tends to cool the compressor and the chamber itself shields the compressor from radiant heat from the combustor.

17 Claims, 5 Drawing Figures

TURBINE ENGINE WITH COMBUSTOR PREMIX SYSTEM

FIELD OF THE INVENTION

The invention relates to a premix system for mixing fuel and air before entering the combustor of a turbine engine. The system includes a primary mixing chamber and a secondary mixing chamber, the latter comprising a plurality of tubes exiting into the combustor with each tube having a plurality of metering ports in the sides to allow compressed air to flow into the tubes. The primary mixing chamber is located adjacent to and between the air compressor and the combustor to shield the compressor.

BACKGROUND OF THE INVENTION

In a typical turbine engine, air is compressed, then mixed with a fuel, and the resulting mixture is ignited in a combustor so that the expanding gases of combustion can rapidly move across and thus rotate turbine blades. The fuel can be liquid or gaseous and the turbine can be an axial flow or a radial in-flow type. Such turbine engines can be used for industrial power or moving an airplane or ground vehicle. Variable or fixed turbine vanes direct the expanding gases from the combustor to the rotatable turbine blades.

While various types of turbine engine designs have been used in the prior art, there are numerous disadvantages and great need for improvement. Thus, many of the prior art turbine engines have combustors that experience temperature peaks, also known as hot spots, which reduce the fuel efficiency of the engine by requiring additional cooling air for cooling of the turbine vanes. This is usually a result of the nozzle design which sprays a fuel and air mixture into the combustor for ignition. In addition, many of these prior art turbine engines operate at very high temperatures, requiring high strength and high temperature-resistant alloys which are very expensive. Moreover, many of these turbine engines require a very long combustor which increases the materials and costs for the engine. Finally, many of these prior art turbine engines require (but do not optimize) the variation of the mixing of fuel and air depending upon the power requirements of the engine which differ during off design engine operation at low power, high power, and starting.

Examples of such prior art turbine engines are disclosed in the following U.S. Pat. Nos. 2,471,892 issued to Price; 2,946,185 issued to Bayer; 4,005,572 issued to Giffhorn; 4,100,733 issued to Striebel et al; and 4,195,476 issued to Wood.

SUMMARY OF THE INVENTION

Accordingly, a primary object of the present invention is to provide a turbine engine with improved fuel efficiency throughout the engine operating range and a homogenous flame front in the combustor to limit the amount of air required to cool the turbine vanes and to reduce temperature peaks in the combustor.

Another object of the present invention is to provide a turbine engine with a combustor premix system eliminating the use of inefficient nozzles.

Another object of the present invention is to provide a turbine engine with a shielding assembly between the combustor and the compressor so that lower strength and lower temperature-resistant alloys can be utilized within the aft compressor section.

Another object of the present invention is to provide an external primary mixing chamber for fuel and air adjacent to or incorporated into the combustor which utilizes the heat therefrom to vaporize the fuel and a secondary mixing chamber adjacent the combustor, all resulting in a shorter combustor in the turbine engine.

A further object of the present invention is to provide a combustor premix system which is capable of mixing optimized vaporized fuel and air through high and low power requirements of the turbine engine and also during starting thereof.

The foregoing objects are basically attained by providing in a turbine engine including a housing having rotatable turbine blades supported therein and a combustion chamber communicating with the turbine blades, the improvement which comprises a primary mixing chamber located in the housing for mixing compressed air and atomized fuel; a mechanism for introducing compressed air into the primary mixing chamber; a mechanism for introducing atomized fuel into the primary mixing chamber; a secondary mixing chamber, located in the housing between the primary mixing chamber and the combustion chamber, for receiving the compressed air and atomized fuel from the primary mixing chamber, the secondary mixing chamber comprising a plurality of tubes for conducting the fuel-air mixture into the combustion chamber; and a mechanism for introducing additional compressed air into the secondary mixing chamber to mix with the fuel-air mixture therein, this mechanism for introducing additional compressed air comprising a plurality of ports in the walls of each of the tubes. This mechanism also includes a metering plate to control air supply to the tubes for off-design operating conditions.

By utilizing the secondary mixing chamber, inefficient nozzles are eliminated from the combustor and the fuel and air are continuously mixed in an efficient manner to reduce hot spots in the combustor by providing a homogenous flame front. In addition, this results in a smaller volume of cooling air passing across the turbine vanes and enhances the potential energy of the engine by increasing the working mainstream mass airflow. Moreover, the secondary mixing chamber can be utilized during all of the power requirements of the turbine.

In addition, a shielding assembly is interposed between the compressor and the combustor to reduce the need for high strength and high temperature resistant alloys in construction of the compressor, this assembly being formed by the primary mixing chamber.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

DETAILED DESCRIPTION OF THE INVENTION

Figure 1:
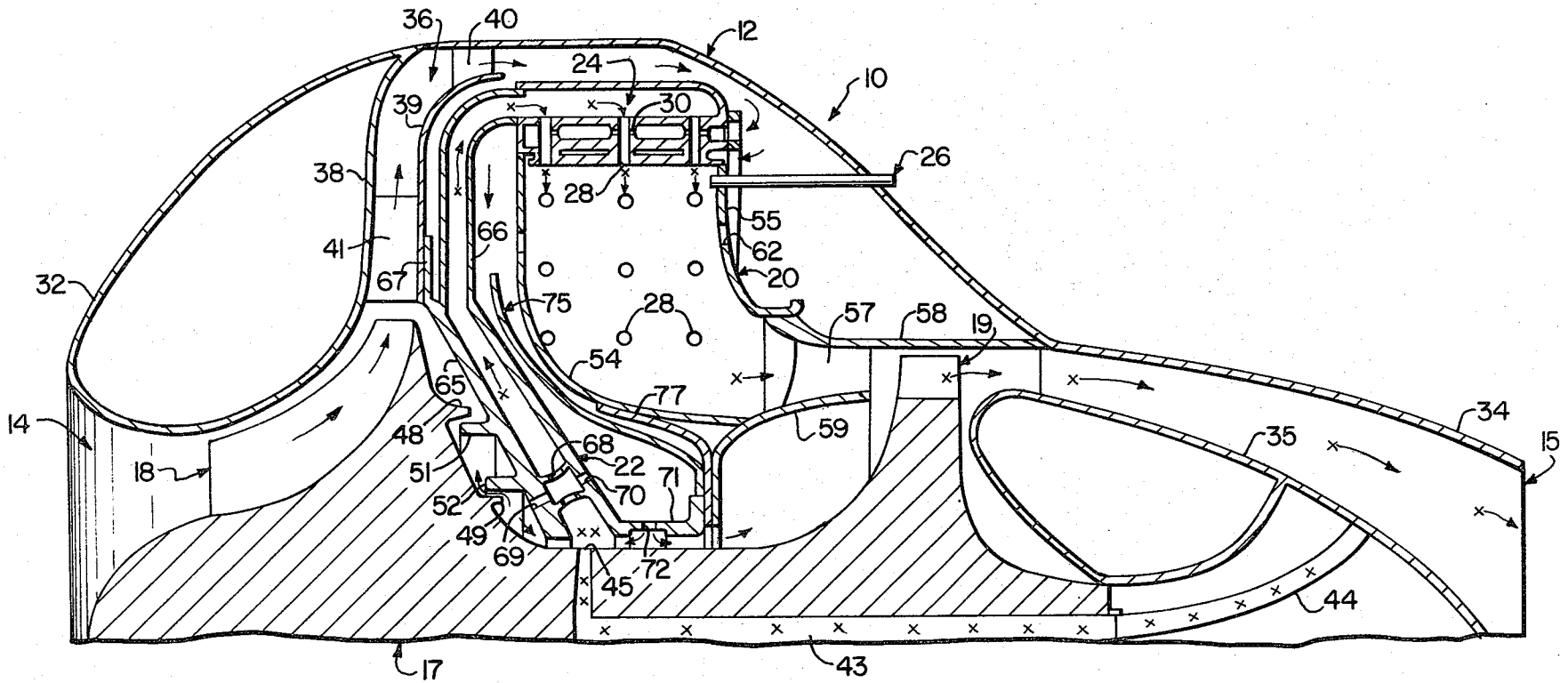
FIG. 1 is a fragmentary side elevational view in longitudinal section of the upper quadrant of an annular axial flow turbojet turbine engine.

Referring now to FIGS. 1–4, the turbine engine 10 in accordance with the present invention comprises a housing 12 having an air inlet 14 and an exhaust 15, a shaft 17 rotatably mounted inside the housing 12 and having a compressor with compressor blades 18 and turbine blades 19 thereon, a combustor 20 located inside the housing and communicating with the turbine blades 19, a primary mixing chamber 22 located inside the housing, and a secondary mixing chamber 24 located between the primary mixing chamber and the combustor.

The basic purpose of the invention is to provide an efficient mixing of air and fuel to be burned in the combustor 20. This is generally accomplished by having atomized fuel introduced into the primary mixing chamber 22 together with compressed air from the compressor blades 18 and diffuser 36 and conducting this mixture to the secondary mixing chamber 24 where additional compressed air is added to the mixture, and this resultant mixture is introduced into the combustor 20 where it is ignited by ignitor 26. The secondary mixing chamber 24 replaces conventional nozzles and includes a plurality of cylindrical tubes 28 having a plurality of cylindrical air metering ports 30 extending transversely through the walls of each tube. The fuel-air mixture from the primary mixing chamber flows through the tubes 28, and additional compressed air from the compressor blades is mixed with the mixture in the tubes via the metering ports 30, as more clearly seen in FIG. 3.

THE HOUSING

As best seen in FIG. 1, the housing 12 has the air inlet 14 defined in its forward end by means of an annular cowling 32 and at its aft end has the exhaust 15 defined by an annular external exhaust tube 34 and an internal annular wall 35. Tube 34 and wall 35 define an annular exhaust passageway for the ignited and burned fuel to exit the engine.

An annular diffuser 36 is formed aft of the annular cowling 32 and includes a front annular wall 38 formed as part of the cowling 32 and an annular rear wall 39 spaced from the front wall to define a flow path of air from the compressor blades 18, this flow path being interrupted by a plurality of diffuser blades 40 and 41. Diffuser blades 41 are radially oriented and adjacent the exhaust tip of the compressor blades while diffuser blades 40 are horizontally oriented and adjacent the wall of housing 12.

THE SHAFT

The shaft 17 is rotatably mounted in a conventional manner inside the housing 12 with the compressor blades 18 at the forward end and the turbine blades 19 at the aft end. The shaft has a flow cavity 43 defined therein which is connected to a fuel line 44 which is in turn connected to a fuel supply. Flow cavity 43 extends longitudinally of the shaft for a certain distance and then extends radially ending in a plurality of fuel ports 45 to deliver atomized fuel into the primary mixing chamber 22 by means of rotation of the shaft. The fuel can be supplied at low pressures of approximately 5 to 15 psi from the fuel line 44.

A pair of air buffer seals 48 and 49 in the form of annular flanges extending rearwardly of the housing are formed on the shaft 17 which mate with similar annular buffer seal flanges 51 and 52 formed on the forward side of the primary mixing chamber 22.

THE COMBUSTOR

Figure 2:
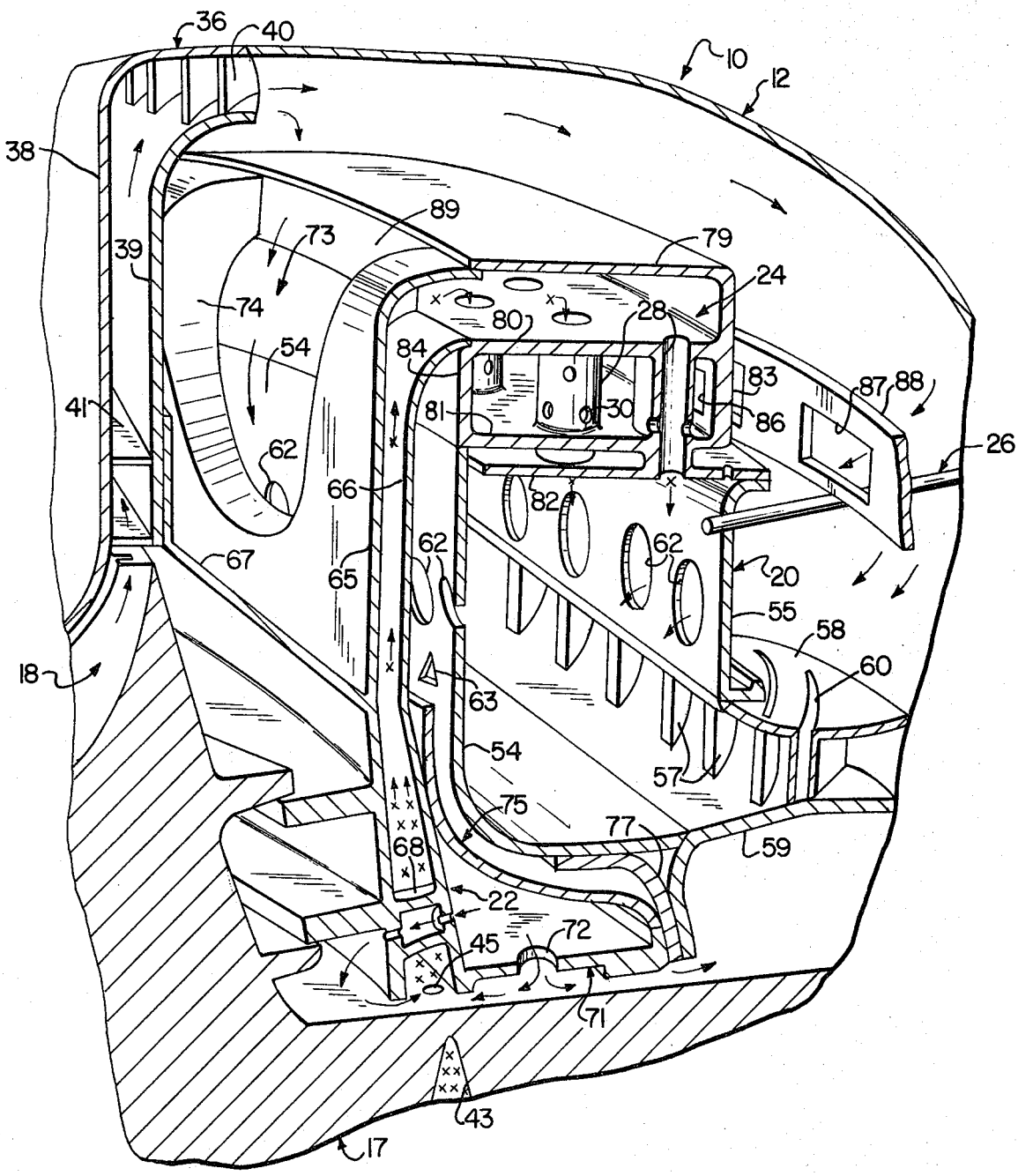
FIG. 2 is a fragmentary enlarged side elevational side perspective view of the engine shown in FIG. 1.

The combustor 20 located inside the housing 12 is annular and is defined on its forward and inboard sides by means of a curved annular wall 54, on its outboard side by the annular secondary mixing chamber 24, and on its aft side by means of a curved annular wall 55 and turbine exit nozzle vanes 57 formed in an annular array. These nozzle vanes can be formed integrally on their outboard surfaces with an annular curved wall 58 and on their inboard surfaces with a curved annular wall 59. As seen in FIG. 2, wall 58 has slots 60 formed therein and extending into each of the vanes 57 to provide cooling air thereto.

The conventional ignitor 26 extends through the outer housing 12 and into the combustor 20 through a suitable aperture in wall 55.

As best seen in FIG. 2, a plurality of dilution orifices 62 are formed in walls 54 and 55 defining the combustor 20 to allow additional compressed air to enter the combustor in a conventional manner. Additional cooling orifices 63 are similarly provided in these walls.

Thus, the walls 54 and 55 together with exhaust nozzle vanes 57 and the secondary mixing chamber 24 define a combustion chamber for igniting and burning a fuel-air mixture in the combustor 20.

THE PRIMARY MIXING CHAMBER

The primary mixing chamber comprises a forward curved annular wall 65 and a corresponding rear curved annular wall 66, both of which extend generally radially of the engine. As seen in FIG. 1, wall 66 is curved at its largest radial position towards the aft end of the housing into contact with the secondary mixing chamber 24. The forward wall 65 is also curved at its largest radial position and extends rearwardly into contact with the forward end of the secondary mixing chamber 24, these walls 65 and 66 thereby forming a radially and axially extending flow passage beginning adjacent the fuel ports 45 on shaft 17 and extending to and communicating with the secondary mixing chamber 24.

Wall 65 has a forwardly and radially extending flange 67 on its forward side in contact with wall 39 of the diffuser 36 as a support.

On the forward edge of wall 65 are the pair of buffer seal flanges 51 and 52 which mate with air buffer seals 48 and 49 on shaft 17.

As seen in FIGS. 1 and 2, the forward and rear walls 65 and 66 of the primary mixing chamber are separated and their inboard edges are located adjacent the plurality of fuel ports 45 so that fuel exiting thereby can enter the primary mixing chamber.

Radially outward of the shaft 17 are a plurality of transfer tubes 68 which extend between walls 65 and 66 of the primary mixing chamber and are coaxial with a plurality of corresponding air ports 69 and 70 located respectively in walls 65 and 66.

Extending in the aft direction from the innermost edge of wall 66 is an annular air buffer seal 71 lying adjacent shaft 17 with a plurality of air ports 72 formed therein, the longitudinal axes of these ports extending in the radial direction of the engine.

As seen in FIG. 2, walls 65 and 66 have a series of U-shaped radial slots 73 formed in their outer peripheries with U-shaped webs 74 interconnecting the walls in the peripheries of the slots. These slots form flow-through passageways for compressed air exiting the diffuser 36.

The primary mixing chamber 22 is located closely adjacent to and between the compressor 18 and the combustor 20 so that the heat from the combustor vaporizes the fuel-air mixture therein and so that the fuel-air mixture, moving through the primary mixing chamber, tends to cool the compressor aft section. In addition, the primary mixing chamber shields the compressor aft section from radiant heat from the combustor. To increase vaporization, wall 66 could be eliminated, which would also cool the combustor and reduce the amount of cooling air to cool the combustor.

THE HEAT SHIELD

A convex-concave annular heat shield 75 extends radially outward from flange 71 in between wall 66 of the primary mixing chamber and wall 54 of combustor 20. This heat shield 75 is rigidly coupled at its aft end to a curved annular support wall 77 which is also coupled at its outboard side to wall 54 and at its aft side to wall 59.

The heat shield 75 does not extend radially outward to the fullest extent of walls 66 and 54 but instead ends before these walls. Thus, fuel flowing radially outwardly in the primary mixing chamber 22 will be vaporized by the radiant heat from wall 54 of the combustor as that fuel passes radially outwardly past the radial extent of the heat shield 75.

THE SECONDARY MIXING CHAMBER

As seen in FIGS. 1–4, the secondary mixing chamber 24 is basically comprised of four annular walls 79, 80, 81 and 82 which are spaced apart and are concentric, with wall 79 being at the largest radial distance from shaft 17. Radially extending through walls 80–82 are a plurality of the cylindrical tubes 28 which are open at their ends so that the fuel-air mixture flowing from the primary mixing chamber can pass therethrough into the interior of combustor 20. While shown integral with walls 80–82, tubes 28 could be threaded at their outward ends and threadedly received in threaded bores in wall 80 with the remainder of the tubes fitting with clearance in bores in walls 81 and 82. This would make the tubes easily removable for maintenance and increase cooling air flow through the clearance.

In addition, each of these tubes 28 has a plurality of air metering ports 30 in the walls thereof, these ports being substantially cylindrical and having their longitudinal axes perpendicular to the longitudinal axis of each tube 28.

As best seen in FIG. 2, an aft wall 83 in the form of an annular ring couples walls 79 and 81 together. A forward annular wall 84 couples walls 80 and 81 together.

Figure 4:
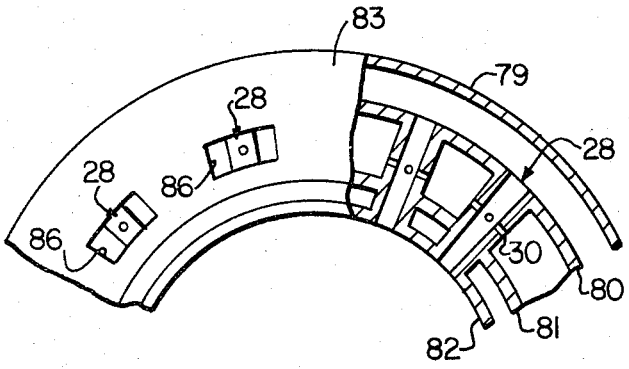
FIG. 4 is a fragmentary rear elevational view of the secondary mixing chamber.

As seen in FIGS. 2 and 4, wall 83 has a plurality of orifices 86 for compressed air to enter into the inside of the secondary mixing chamber, which orifices can be aligned with orifices 87 in an annular metering plate 88 which can be selectively moved relative to orifices 86 to control and meter the amount and rate of compressed air entering the secondary mixing chamber, at off-design engine operating conditions.

Wall 65 in the primary mixing chamber contacts wall 79 in the secondary mixing chamber and wall 66 similarly contacts wall 80.

Between walls 79 and 80 in the area of the slots 74 in the primary mixing chamber are a plurality of plates 89 closing off the forward side of the secondary mixing chamber.

OPERATION

In operation of the turbine engine 10 in accordance with the present invention, air and fuel are first delivered to the primary mixing chamber, then to the secondary mixing chamber where additional air is added and then this resultant mixture is ignited in the combustor and expands through nozzle vanes 57 past turbine blades 19 and out via exhaust 15.

The air forming the mixture (illustrated by simple arrows in the drawings) enters the engine via air inlet 14, is compressed by rotating compressor blades 18 and then passes through the diffuser 36. From there, the air proceeds aft of the combustor and into the combustor via dilution orifices 62 and cooling orifices 63 and also into the secondary mixing chamber via orifices 87 in the metering plate and 86 in the chamber itself. In addition, compressed air flows from the diffuser through the various slots 73 in the primary mixing chamber into the space between the primary mixing chamber and the combustor. The air therein also flows through buffer air ports 72 in flange 71 and then into the primary mixing chamber. Similarly, air flows from the area between the primary mixing chamber and the combustor via transfer tubes 68 in the primary mixing chamber and then into the primary mixing chamber itself.

At the same time, the shaft rotates and has fuel delivered therethrough via fuel line 44 and flow cavity 43 so that it is expelled under centrifugal force via fuel ports 45 into the primary mixing chamber 22. This rotation of the shaft and slinging of the fuel also results in atomization of the fuel. The fuel is illustrated by a plurality of X's in the drawings.

The fuel which is now atomized and the compressed air located in the primary mixing chamber 22 are mixed and flow radially outwardly of the primary mixing chamber past the heat shield 75. The mixed fuel and air is illustrated by arrows with X's at the tail ends in the drawings. At this point, the heat from the combustor will vaporize the fuel in the rich, non-autoignitable air-fuel mixture. This mixture then flows radially and then rearwardly into the tubes 28 of the secondary mixing chamber 24. While inside these tubes, the vaporized fuel-compressed air mixture has additional compressed air added thereto via air metering ports 30, this compressed air entering the secondary mixing chamber via the variable combination of orifices 86 therein and orifices 87 in the metering plate 88.

The resultant mixture of compressed air and vaporized fuel then exits from the secondary mixing chamber 24 and is ignited via ignitor 26 in the combustor 20. Additional compressed air is mixed with the fuel in the combustor via dilution orifices 62 and cooling orifices 63. The radial flame profile can be defined through conventional cooling air methods.

The expanding ignited fuel flows radially inwardly and then axially rearwardly past the nozzle vanes 57 and across turbine blades 19, resulting in rotation of these blades and therefore of the shaft 17. The exhaust gases which pass by the blades then exit the engine via exhaust 15.

Thus, the secondary mixing chamber 24 takes the place of conventional nozzles in a combustor and provides combustion with a minimum of temperature peaks in the combustor.

While a radial in-flow combustor is illustrated, the present invention can be utilized with various different types of combustors including can types, can annular types, scroll types, reverse flow annular types and axial types. Moreover, the present invention can be utilized with radial in-flow and axial flow turbine engines utilizing liquid or gaseous fuel injecting fuel into the primary mixing chamber by conventional fuel nozzles, radial slingers or injectors. These engines can be of the turbofan, turbojet or turboprop type for aircraft, can be stationary engines used in industrial facilities or can be used in ground vehicles.

EMBODIMENT OF FIG. 5

Figure 3:
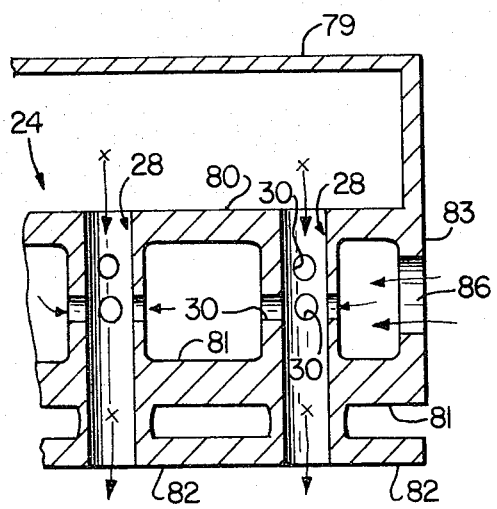
FIG. 3 is an enlarged side elevational view in section of the tubes and air metering ports in the secondary mixing chamber in accordance with the present invention.
Figure 5:
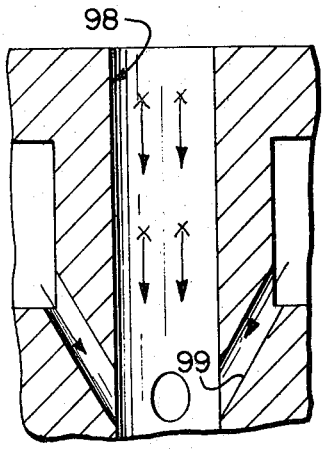
FIG. 5 is a side elevational view in section of a tube with a plurality of air metering ports exiting therein which is a modification of that shown in FIG. 3.

As seen in FIG. 5, a modified secondary mixing chamber is shown where the tubes 98 therein are the same as that shown in FIG. 3; however, the air metering ports 99 are different in that the longitudinal axes thereof are at an acute angle of, for example, about 45° to the longitudinal axis of the tube.

While various advantageous embodiments have been utilized to illustrate the present invention, it will be understood by those skilled in the art that various changes and modifications can be made therein without departing from the scope of the invention as defined in the appended claims.

What is claimed is:

1. In a turbine engine including a housing having rotatable turbine blades supported therein and a combustion chamber communicating with the turbine blades, the improvement comprising:

a primary mixing chamber located in said housing for mixing compressed air and atomized fuel;

means for introducing compressed air into said primary mixing chamber;

means for introducing atomized fuel into said primary mixing chamber;

a secondary mixing chamber, located in said housing between said primary mixing chamber and said combustion chamber, for receiving the compressed air and atomized fuel from said primary mixing chamber, said secondary mixing chamber comprising a plurality of tubes for conducting the fuel-air mixture into said combustion chamber; and means for introducing additional compressed air into said secondary mixing chamber to mix with the fuel-air mixture therein, said means for introducing additional compressed air comprising a plurality of ports in the walls of each of said tubes.

2. The improvement according to claim 1, wherein said tubes are substantially cylindrical.

3. The improvement according to claim 1, wherein said ports are substantially cylindrical, with the longitudinal axes thereof being substantially perpendicular to the longitudinal axis of the associated tube.

4. The improvement according to claim 1, wherein said ports are substantially cylindrical, with the longitudinal axes thereof being inclined at an acute angle to the longitudinal axis of the associated tube.

5. The improvement according to claim 1, wherein the longitudinal axes of said tubes extend radially from the longitudinal axis of said housing.

6. The improvement according to claim 1, wherein said plurality of tubes are arranged in an annular array.

7. The improvement according to claim 1, wherein said means for introducing compressed air into said primary mixing chamber comprises a compressor, and said primary mixing chamber is located in said housing between said combustion chamber and said compressor.

8. The improvement according to claim 1, and further comprising means for controlling the rate of introduction of the additional compressed air into said secondary mixing chamber.

9. In a turbine engine including a housing having rotatable turbine blades supported therein and a combustion chamber communicating with the turbine blades, the improvement comprising:

a primary mixing chamber located in said housing for mixing compressed air and atomized fuel and for delivering this mixture to the combustion chamber, said primary mixing chamber extending generally radially of said housing;

means for introducing compressed air into said primary mixing chamber;

means for introducing atomized fuel into said primary mixing chamber;

said primary mixing chamber being located adjacent said combustion chamber so that the heat from said combustion chamber vaporizes the fuel-air mixture therein;

a secondary mixing chamber, located in said housing between said primary mixing chamber and said combustion chamber and including a plurality of tubes, for receiving the compressed air and vaporized fuel from said primary mixing chamber; and means for introducing additional compressed air into said secondary mixing chamber to mix with the fuel-air mixture therein, said means for introducing additional compressed air including ports in walls of said tubes.

10. In a turbine engine including a housing having rotatable turbine blades supported therein and a combustion chamber communicating with the turbine blades, the improvement comprising:

a primary mixing chamber located in said housing for mixing compressed air and atomized fuel and for delivering this mixture to the combustion chamber;

a compressor for introducing compressed air into said primary mixing chamber;

means for introducing atomized fuel into said primary mixing chamber;

said primary mixing chamber being located adjacent said combustion chamber so that the heat from said combustion chamber vaporizes the fuel-air mixture therein, and located between said compressor and said combustion chamber so that the fuel-air mixture moving through said primary mixing chamber tends to cool said compressor;

a secondary mixing chamber, located in said housing between said primary mixing chamber and said combustion chamber and including a plurality of tubes, for receiving the compressed air and vaporized fuel from said primary mixing chamber; and means for introducing additional compressed air into said secondary mixing chamber to mix with the fuel-air mixture therein, said means for introducing additional compressed air including ports in walls of said tubes.

11. The improvement according to claim 10, wherein said means for introducing additional compressed air includes said compressor.

12. A method of combusting an air and fuel mixture in a turbine engine, comprising the steps of atomizing the fuel, mixing compressed air with the atomized fuel, passing the atomized fuel-compressed air mixture between a compressor and combustion chamber to cool the compressor, vaporizing the fuel in the atomized fuel-compressed air mixture, passing the vaporized fuel-compressed air mixture through tubes having ports in walls thereof, passing additional compressed air through the ports, mixing the additional compressed air with the vaporized fuel-compressed air mixture in the tubes, and igniting the resultant mixture.

13. The method according to claim 12, wherein the step of atomizing the fuel includes the step of slinging the fuel radially of the engine.

14. The method according to claim 12, wherein the step of vaporizing the fuel includes the step of conducting the fuel closely adjacent to the ignited mixture.

15. The improvement according to claim 9, and further comprising means for controlling the rate of introduction of additional compressed air into said tubes.

16. The improvement according to claim 10, and further comprising means for controlling the rate of introduction of additional compressed air into said tubes.

17. The method according to claim 12 wherein the rate the additional compressed air is introduced into said tubes is adjustably controlled.

* * * * *